United States Patent [19]

Finney et al.

[11] 4,358,425

[45] Nov. 9, 1982

[54] PENETRABLE CENTRIFUGE TUBE

[75] Inventors: Jack P. Finney, Hillsborough; Kenzo Ishimaru, San Jose, both of Calif.

[73] Assignee: Beckman Instruments, Inc., Fullerton, Calif.

[21] Appl. No.: 235,328

[22] Filed: Feb. 17, 1981

[51] Int. Cl.[3] ..... B01L 3/00; B65D 39/00

[52] U.S. Cl. ..... 422/102; 215/247; 215/355; 233/26

[58] Field of Search ..... 422/101, 102, 72; 210/514, DIG. 24; 495/296; 215/247, 355; 233/26; 220/306, 307; 128/272, 218 NV, 218 M, 218 D

[56] References Cited

U.S. PATENT DOCUMENTS

| | | | |
|---|---|---|---|
| 302,565 | 7/1884 | Hoyt . | |
| 1,424,187 | 8/1922 | Seelman . | |
| 2,135,386 | 11/1938 | Crabbe | 215/247 |
| 2,649,245 | 8/1953 | Silverstolpe | 233/26 |
| 2,820,590 | 1/1958 | Walker | 233/26 |
| 2,848,130 | 8/1958 | Jesnig | 215/247 |
| 2,861,570 | 11/1958 | Beecher | 128/215 |
| 2,876,775 | 3/1959 | Barr, Sr. et al. | 128/272 |
| 3,081,029 | 3/1963 | Gauslaa | 233/26 |
| 3,121,310 | 2/1964 | Rice | 220/307 |
| 3,875,012 | 4/1975 | Dorn et al. | 128/218 M |
| 3,897,902 | 8/1975 | Yanez, Jr. | 233/26 |

FOREIGN PATENT DOCUMENTS

| | | | |
|---|---|---|---|
| 565193 | 11/1932 | Fed. Rep. of Germany | 421/6 |
| 903384 | 2/1954 | Fed. Rep. of Germany | 421/6 |
| 1074398 | 3/1954 | France . | |

*Primary Examiner*—Frank W. Lutter
*Assistant Examiner*—Chris Konkol
*Attorney, Agent, or Firm*—R. J. Steinmeyer; F. L. Mehlhoff; Al A. Canzoneri

[57] ABSTRACT

A transparent tube for use in the cavity of the rotor of a high speed centrifuge. The tube is penetrable at its bottom end by a needle of a hypodermic syringe. The tube is open at the top and has a rounded bottom with an opening forming a passageway therein. A recess forming a shoulder co-axial with the passageway is provided both on the inner side and the outer side of the tube. A resilient plug having flanges at each end provides a tight fitting closure for the passageway and recesses.

1 Claim, 2 Drawing Figures

PENETRABLE CENTRIFUGE TUBE

BACKGROUND OF THE INVENTION

This invention relates to apparatus for high speed centrifuging and, more specifically, to centrifuge tubes which are particularly useful for obtaining analytical samples.

In the field of high speed centrifugation, it is frequently desired to draw off a sample of a sedimentation specimen from a centrifuge test tube. Since the sedimentation layer of interest lies at a specific level in the tube, it is necessary to capture the sample without causing it to become remixed with an adjacent layer. A Pasteur pipette or hypodermic needle and syringe can be used to draw off the desired fraction through the mouth of the tube. If the particles are of a size which can be detected visually, it is most desirable for the centrifuge test tube to be transparent so as to enable visual identification of the desired fraction. It is known that extraction of a heavy sedimentation fraction can be made with some advantage from the bottom of a centrifuge tube because the heaviest particles lie closest to the tube bottom. To do this, a syringe having a hypodermic needle is utilized in conjunction with a test tube having a penetrable bottom. A centrifuge tube of this type is disclosed by Kjetil Gauslaa in U.S. Pat. No. 3,081,029 entitled "Improved Centrifuge Tube", issued Mar. 12, 1963. The Gauslaa tube, however, has several drawbacks. One disadvantage, for example, is that the tube which is made of metal, is not transparent and, thus, the user cannot view the sedimentation pattern, nor can he visually monitor his effort to extract the fraction of his choosing. Another drawback of this metal construction is that it makes the tube heavier than tubes made of plastic. The greater tube weight may require that the centrifuge rotor be restricted to a lower speed range to prevent its being overstressed, with the result that longer centrifugation cycles may be necessitated. Finally, the Gauslaa tube is obviously complex and relatively expensive to manufacture.

Another centrifuge tube having a penetrable bottom is disclosed by Gordon L. Dorn et al. in U.S. Pat. No. 3,875,012 entitled "Apparatus and Method for the Detection of Microbial Pathogens", issued Apr. 1, 1975. The Dorn tube is essentially a right circular cylinder closed by a resilient stopper at each end. Although it is possibly capable of withstanding somewhat more, the Dorn tube is specified for use only up to 6,000 G's. It may be seen by inspection that the design of the Dorn tube is unsuited to withstand forces in the range of 150,000 gravities without leaking. This is evident by the disposition of the straight sided tube which is employed, and which would be subject to expansive deformation and resultant leakage under extreme load.

Accordingly, there has been shown to be a need for a puncturable-bottom centrifuge tube which is transparent and which can withstand forces in the region of 150,000 G's.

SUMMARY OF THE INVENTION

The present invention provides a transparent centrifuge tube for use in the cavity of the rotor of a high speed centrifuge. The tube of the invention is penetrable at its bottom end by a needle of a hypodermic syringe. The tube is open at the top and has a rounded bottom with an opening forming a passageway therein. A recess forming a shoulder co-axial with the passageway is provided both on the inner side and the outer side of the tube. A resilient plug having flanges at each end provides a tight fitting closure for the passageway and recesses.

Other features and advantages of the invention will become apparent by reference to the detailed description and the accompanying drawing.

DETAILED DESCRIPTION

Figure 1:
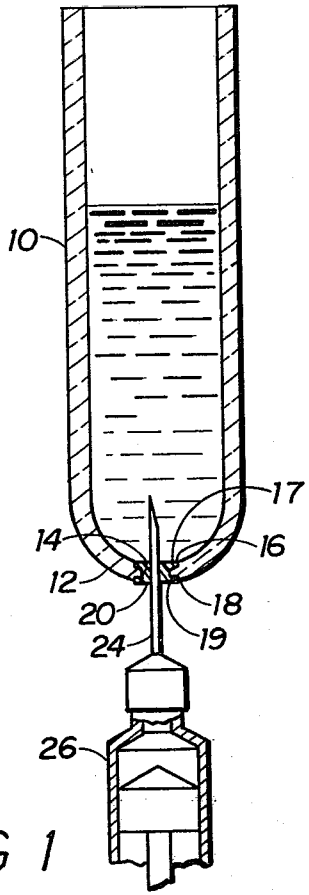
FIG. 1 is a cross-sectional view of the tube of the invention showing a portion of its contents being withdrawn by means of a hypodermic syringe.

As shown in FIG. 1, the centrifuge tube 10 of the present invention has a rounded bottom 12 containing a passageway 14. A recess 16 co-axial with the passageway 14 is provided on the inner side of tube 10 and another recess 18 also co-axial with the passageway 14 is provided on the outer side of tube 10. In the preferred embodiment, the shoulder 17 formed by the recess 16 is of conical shape, and the shoulder 19 formed by the recess 18 is orthogonal with respect to the axis of the passageway 14. A tight fitting resilient plug 20 is disposed in the passageway 14.

Figure 2:
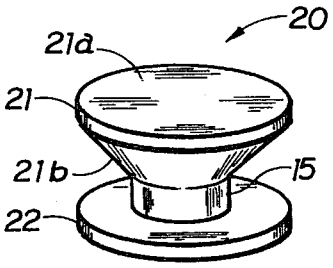
FIG. 2 is a perspective view of the resilient plug employed by the invention.

Referring now to FIG. 2, there is shown a perspective view of the plug 20. The plug 20 includes a round central body 15 connecting with a concentric upper flange 21 having a perpendicular outer face **21*a*, and a conical inner face 21*b*, and the other end of the body 15 connecting with a disc shaped lower flange 22. The plug 20 is dimensioned to provide a leak-tight closure for the passageway 14 and recesses 16 and 18**.

Turning back to FIG. 1, it will be seen that the extraction of a desired sedimentation fraction is accomplished by piercing the resilient plug 20 with the needle 24 of a hypodermic syringe 26 and drawing out the liquid. In this way, the constituents of a desired strata may be withdrawn from the tube without having it remix with adjacent layers.

Preferably, the centrifuge tube 10 is made of polycarbonate or polysulfone to provide a relatively thick walled, rigid, transparent tube that can be autoclaved. The resilient plug is fabricated from a suitable elastomeric type material such as silicone rubber, or a polyester elastomer known as Hytrel. Preferably, the plug 20 is premolded and then installed in the passageway 14 of the tube 10. The installation can be conveniently made by inserting the plug into the recess 18 on the outer side of the tube. Sufficient force must be applied to the plug 20 to temporarily deform the upper flange 21 and allow the plug to seat in the passageway 14. When properly seated, the plug recovers its original shape by virtue of its elastic character. This property also enables the plug to be in tight contact with the surfaces of the recesses and the passageway to make a leak proof seal. Dislodgement of plug 20 in the course of penetrating it with a hypodermic needle is prevented by the face-to-face interference between the lower flange 22 of plug 20 and the shoulder 19 of the centrifuge tube 10. In the same way, dislodgement of the plug 20 during withdrawal of an inserted hypodermic needle is prevented by the contact between the upper flange 21 of plug 20 and the conical shoulder 17 of the centrifuge tube 20. Additionally, the flanges on plug 20 serve to enhance the plug's sealing characteristics by providing a somewhat tortuous path for any fluid flow. During centrifugation, the fluid pressure acting on the plug forces the elastomeric material against the surfaces of the passageway 14 to make a tight seal therewith. It is important, however, that the centrifuge tube 10 be contained in a close fitting cavity in order to uniformly distribute the load forces and thereby enable the tube to withstand forces of at least 150,000 G's without leaking.

It is thus apparent that there has been provided, in accordance with the invention, a penetrable centrifuge tube that provides the features and advantages which have been set forth above. While the invention has been described with reference to a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A transparent centrifuge tube for use in the cavity of the rotor of a high speed centrifuge, and having a bottom penetrable by the needle of a hypodermic syringe comprising:

a cylindrical tube open at the top and having a rounded bottom;

a passageway in the bottom of said tube;

said passageway including a recess, on the inner side of the tube;

said recess on the inner side of the tube including a shoulder having an inverted conical shape;

said passageway also including a recess on the outer side of the tube;

said recess on the outer side of the tube including a shoulder co-axial with respect to said passageway;

a resilient plug disposed in said passageway providing a tight fitting closure therefor;

said plug having a round central body;

an inverted conical flange connecting with the upper end of said round central body; and a disc-shaped flange connecting with the lower end of said round central body.

* * * * *